US008694386B1

(12) United States Patent
Scherer et al.

(10) Patent No.: US 8,694,386 B1
(45) Date of Patent: Apr. 8, 2014

(54) ONLINE AUCTION SYSTEM AND METHOD

(76) Inventors: Rickie Scherer, Staten Island, NY (US); Cindy Scherer, Coral Springs, FL (US)

( * ) Notice: Subject to any disclaimer, the term of this patent is extended or adjusted under 35 U.S.C. 154(b) by 179 days.

(21) Appl. No.: 13/225,133

(22) Filed: Sep. 2, 2011

Related U.S. Application Data

(60) Provisional application No. 61/379,567, filed on Sep. 2, 2010.

(51) Int. Cl.
*G06Q 30/00* (2012.01)

(52) U.S. Cl.
USPC ..... 705/26.1; 705/27.1

(58) Field of Classification Search
USPC ..... 705/26.1, 27.1
See application file for complete search history.

(56) References Cited

U.S. PATENT DOCUMENTS

| | | | | |
|---|---|---|---|---|
| 6,012,045 | A | 1/2000 | Barzilai et al. | |
| 6,023,685 | A | 2/2000 | Brett et al. | |
| 6,366,891 | B1 | 4/2002 | Feinberg | |
| 7,152,042 | B1 | 12/2006 | Arkes | |
| 7,904,347 | B2 | 3/2011 | Hasseler | |
| 8,027,880 | B2 | 9/2011 | Darveau-Garneau | |
| 8,219,459 | B1 * | 7/2012 | Lark et al. | 705/26.3 |
| 2004/0193529 | A1 | 9/2004 | Asher et al. | |
| 2006/0080224 | A1 * | 4/2006 | Schuelke et al. | 705/37 |
| 2006/0274364 | A1 | 12/2006 | Hasseler | |
| 2008/0010077 | A1 | 1/2008 | Hasseler | |
| 2008/0195412 | A1 | 8/2008 | Gologorsky et al. | |
| 2010/0318416 | A1 | 12/2010 | Seymour et al. | |
| 2011/0066518 | A1 | 3/2011 | Mack et al. | |

* cited by examiner

*Primary Examiner* — James Zurita
(74) *Attorney, Agent, or Firm* — Malloy & Malloy, P.L.

(57) ABSTRACT

An online auction system and method comprising a single access fee for participation and allowing participants to place bids free of charge. The system comprises an auction management assembly in communication with a network, an auction event structured to present information pertaining to an auction item, access fee defining entry to the auction event, and at least one bid independent of an associated fee. In some embodiments, the system comprises an entry requirement and entry fee. In some embodiments, the system comprises an auction room having a plurality of auction events, and a single entry fee for access to auction room and its contents. The method comprises receiving, storing, and presenting auction item information, establishing an access fee, receiving indication of payment of the access fee, commencing an auction event, allowing participants to access the auction and place multiple bids free of charge, and facilitating completion of the auction event.

15 Claims, 8 Drawing Sheets

ONLINE AUCTION SYSTEM AND METHOD

CLAIM OF PRIORITY

The present application is based on and a claim of priority is made under 35 U.S.C. Section 119(e) to currently pending provisional patent application having Ser. No. 61/379,567 filed on Sep. 2, 2010, which is incorporated herein by reference in its entirety.

BACKGROUND OF THE INVENTION

1. Field of the Invention

The present invention is directed to a system and method of auctioning at least one item over a network, comprising a single access fee for participation in at least one auction event, and allowing participants to place a plurality of subsequent bids free of charge.

2. Description of the Related Art

Auctions have been employed over the years to sell a variety of items, goods, and property. Specifically, auctions traditionally involve participants who submit bids for a particular item, wherein the bid reflects an amount the participant is willing to pay for the item. Multiple participants engage in the auction and vie for the same auction item, each placing one or a plurality of bids in an attempt to out-compete the other participants in the auction and win the item. A participant "wins" the item if they submit a bid that no other participant is willing to exceed.

Auctions take many forms. For instance, live auctions have classically been conducted by an auctioneer who presents the physical auction item and verbally seeks bids from participants gathered before the auctioneer. A minimum bid is suggested, or a maximum price is established, and the floor is opened to bids from the participants until one participant wins the item. Some auctions proceed on paper, and are thus termed "silent auctions." In these silent auctions, there is no auctioneer, but rather a piece of paper placed near the auction item, and participants write their bids on the piece of paper. The auction remains open for a predetermined period of time, after which the participant with the most recent and/or and highest bid wins the item.

Since the dawn of the digital age, auctions are now also conducted online, such as over the Internet. Participants can place a bid with the click of a button, and the host website often presents information pertaining to the auction, including time remaining for the auction, or the current bid amount. Moreover, in some online auctions, the price for the auction item can only be increased in certain monetary increments, which can be as little as a penny per each bid, as in the case of "penny auctions." In some auctions, the time remaining is reset every time a bid is placed, or when a bid is placed within a particular time window, such as in the last seconds of the auction. Accordingly, known auctions encourage the participants to continue bidding.

Many online auctions attract and entice people to participate by touting the sale of auction items at prices drastically lower than retail value, and hence appear to offer savings to participants. However, these online auctions also charge a fee for each bid placed, creating hidden fees that increase the total amount of money a participant pays for an item. Moreover, participants are charged for every bid placed, even if he/she does not ultimately win the item.

The field of online auctions is in need of an auction system to sell items at reduced prices and still effectively save participants money.

SUMMARY OF THE INVENTION

The present invention is directed to a system and method of auctioning at least one item over a network, comprising a single access fee for participation in an auction event, and allowing participants to place a plurality of subsequent bids free of charge. Specifically, at least one embodiment of the present system comprises an auction management assembly including communication capabilities structured for communicative relation with a network, such as the Internet, Wi-Fi®, or BlueTooth®. Moreover, the auction management assembly is accessible to a plurality of participants through the network.

The system also comprises at least one auction event structured to present information pertaining to a particular auction item. Further, the system includes an access fee defining entry of each participant to a given auction event. Each auction event is associated with a corresponding access fee. In at least one embodiment, the system comprises an entry requirement defining a threshold participation value and which is intended to restrict access to an auction event, as well as an entry fee comprising a value amount equivalent to the threshold participation value.

The present system further comprises at least one bid indicative of an attempt to purchase or suggest a price for the auction item by a participant. Moreover, the at least one bid is independent of an associated cost to place the bid, and as such is free of charge.

The present invention is also directed to a method for providing a single fee online auction. The method comprises receiving information of an auction item from the item donor, such as the identity of the auction item, its suggested value, measurements or other size indicators, condition status, etc. The item donor may donate the item and expect no payment in return, or may provide the item in order to receive payment for the auctioning of the item. The present method also includes storing the auction item information in the auction management assembly. For example, the auction item information is stored in the memory of a computing device disposed in communicative relation with the network. The method further includes presenting the auction item information from the auction management assembly to the network so that the auction item information is viewable and/or accessible to a user.

In at least one embodiment, the method also comprises establishing an access fee associated with the auction event in which a particular item is auctioned off. Further, the method includes receiving an indication of payment of the access fee by at least one participant, which can be received from any number of sources, such as directly from the participant, from a banking authority conveying payment information or confirming receipt thereof, etc. The method also includes allowing a participant to access the auction event upon receiving indication of payment of the access fee, and allowing the participant to place a plurality of bids free of charge. The method further comprises facilitating the completion of the auctioning of the auction item.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
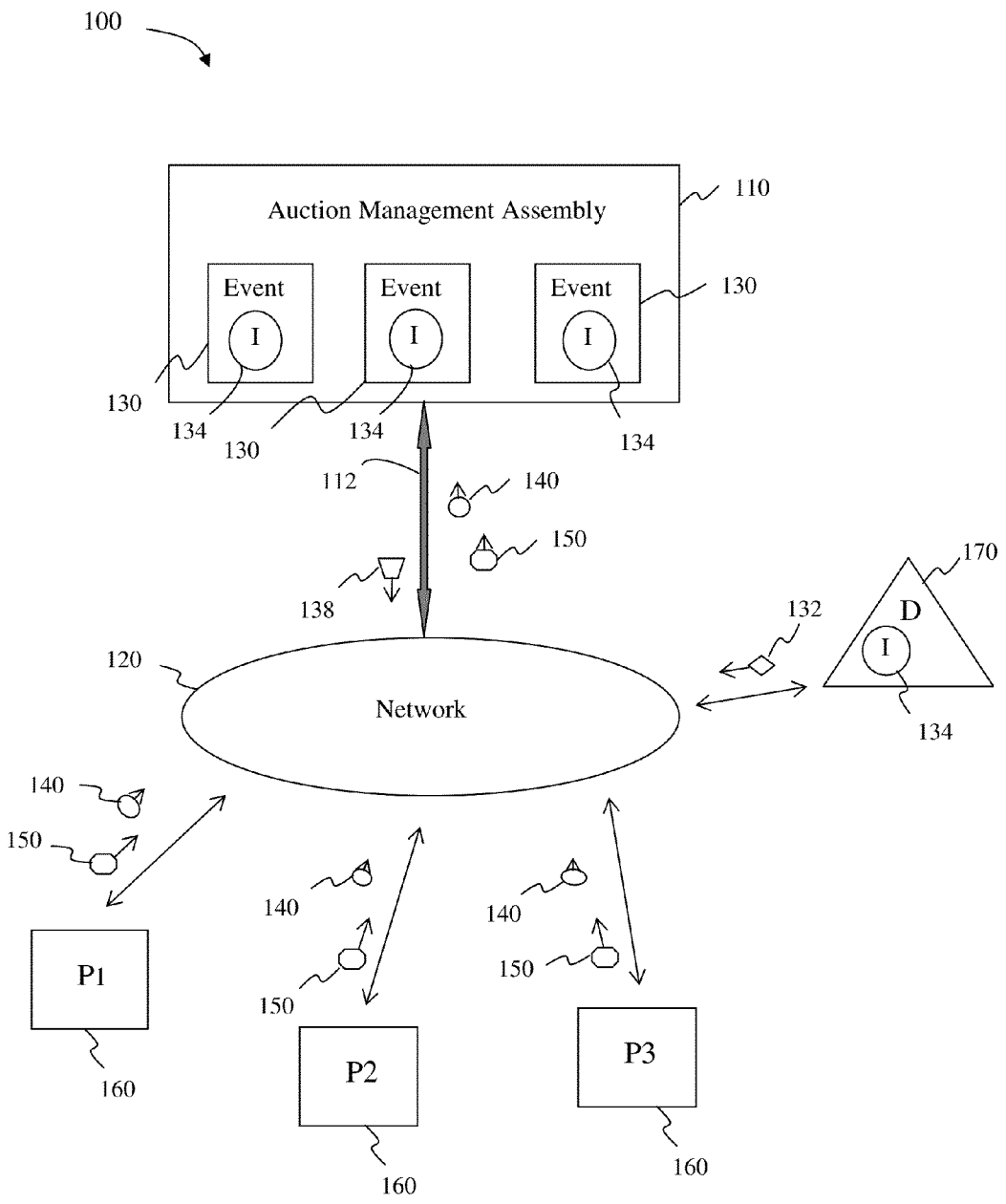
FIG. 1 is a schematic diagram illustrating the online auction system of the present invention.

As shown in the accompanying figures, the present invention is directed to a system and method of auctioning at least one item over a network, comprising a single access fee for participation in an auction event, and allowing participants to place a plurality of subsequent bids free of charge. The system of the present invention, generally indicated as 100 and shown schematically in FIG. 1, comprises an auction management assembly 110 including communication capabilities 112 structured for communicative relation with a network 120, at least one auction event 130, an access fee 140, and at least one bid 150.

Specifically, in at least one embodiment as shown in FIG. 1, the auction management assembly 110 includes communication capabilities 112 for communicative relation of the auction management assembly 110 with a network 120. The network 120 may comprise the Internet or other access to the World Wide Web. It is also contemplated that, in at least one embodiment, the network 120 comprises a private, limited, or other computer network such as an Intranet, Extranet, Local Area Network ("LAN"), or Wide Area Network ("WAN"). In another embodiment, the network 120 comprises an interactive connection between the auction management assembly 110 and at least one mobile device, such as through a Wi-Fi® or Bluetooth® connection. Accordingly, the network 120 allows and facilitates interaction of the auction management assembly 110 and its components with other elements of the present system 100, as well as with actors, such as a participant 160 or a donor 170, explained in further detail below.

Further, the communication capabilities 112 include structure which facilitates communication with the network 120. For example, in at least one embodiment, the communication capabilities 112 are physical connections, such as cables or other hard wiring between the auction management assembly 110 and the network 120, such as USB cables. In other embodiments, the communication capabilities 112 comprise structure capable of achieving a wireless or digital connection with the network 120. Moreover, the communication capabilities 112 are structured to permit either direct or indirect connection between the auction management assembly 110 and the network 120. For example, in the embodiment of FIG. 1, the auction management assembly 110 connects directly to a network 120 through the communication capabilities 112. In other embodiments, the auction management assembly 110 is interconnected to a network 120, and the communication capabilities 112 are structured to connect the auction management assembly 110 to at least one, but possibly a plurality, of additional elements before connecting to the network 120.

In the embodiment of FIG. 1, the auction management assembly 110 is configured to receive information 132 pertaining to an auction item 134 from a donor 170 who provides the auction item 134. "Donor" can mean a party or entity that donates the auction item 134, and does not receive payment for the sale of the auction item 134. "Donor" can also mean a party or entity that provides an auction item 134 and receives payment upon the sale of the auction item 134. In at least one embodiment, the "donor" may be the same individual or entity as the coordinator of the auction, such as when the auction coordinator sells its own items via the present auction system and method. The auction item 134 provided by the donor 170 is sold through the auction system and method of the present invention. However, it should be understood that the auction management assembly 110 of the present system is configured to receive information 132 pertaining to the auction item 134, and not the physical auction item 134 itself. Moreover, the auction management assembly 110 is configured to receive the information 132 pertaining to the auction item 134 via the network 120, as discussed above and as shown in FIG. 1.

Figure 2:
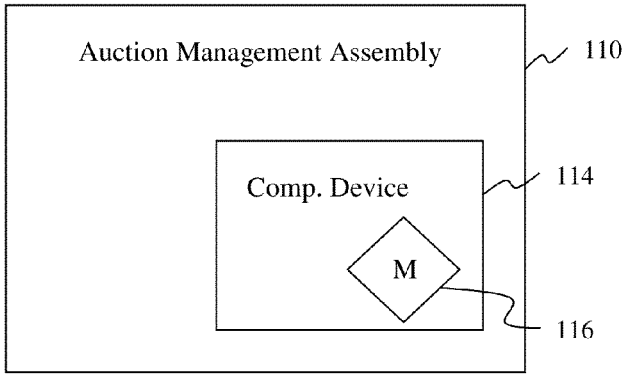
FIG. 2 is a schematic representation of one embodiment of the auction management assembly of the present invention.

The auction management system 110 comprises at least one computing device 114, as depicted in FIG. 2. The computing device 114 may be a computer and/or server having at least a central processing unit, and in some embodiments includes a user interface, display, and/or other components. Moreover, the computing device 114 is configured to host at least one auction event 130, in that the computing device 114 is structured to receive, retain, present, and transmit information 132 pertaining to the auction item 134 to a network 120, so that the information 132 is accessible to at least one user therethrough, who may be a participant 160 in the auction, a donor 170 of an auction item 134, or a coordinator (not shown for purposes of clarity) of the auction system. In another embodiment, the auction management system 110 comprises a plurality of computing devices 114 that are collectively and/or cooperatively configured and disposed to host at least one auction event 130.

Further, in the embodiment of FIG. 2, the at least one computing device 114 includes memory 116 which is structured to store the information 132 pertaining to an auction item 134 therein. The memory 116 may include varieties of random access memory ("RAM"), read only memory ("ROM"), temporary storage (such as cache files), flash memory (as on a mobile device such as a USB key or thumb-drive, or other solid state device), data storage drive (such as a hard drive of the computing device 114, which may include long-term storage), etc. Accordingly, the memory 116 in at least one embodiment of the present system is configured for short-term, or temporary, storage of the information 132. In at least one other embodiment, the memory 116 is configured for long-term storage. In still another embodiment, the at least one computing device 114 comprises a plurality of memory 116, all of which may be short-term memory, long-term memory, or combinations thereof. Further, in embodiments comprising a plurality of computing devices 114, each computing device 114 comprises at least one memory 116 as described above.

The information 132 of the present system 100 comprises any of a number of elements, such as, but not limited to, the identity of the auction item 134, its suggested value, measurements, dimensions or other size indicators, materials, condition status, and/or other elements or descriptors 136 that describe the auction item 134. In at least one embodiment, the information 132 pertaining to an auction item 134 comprises identification of the auction item 134 that is accessible to a participant 160 during the auction event 130. Accordingly, in at least one embodiment of the present system, the identity of the auction item 134 is presented, accessible, and/or known to a participant 160 during the course of the auction event 130, such as depicted schematically in FIG. 5A and discussed in greater detail hereinafter. On the other hand, in the embodiment of FIG. 5B, the information 132 includes identification of the auction item 134 that is concealed from a participant 160 during an auction event 130. That is to say, even though the information 132 includes the identification of an auction item 134, this identity may be hidden or concealed from the participant 160 while the auction event 130 is open and bids are accepted.

However, even if the identity of the auction item 134 is concealed from, or not accessible to, a participant 160 during the auction event 130, other relevant information 132 may be available.

For example, in one embodiment, the information 132 pertaining to an auction item 134 includes a gender suggestion of the auction item 134, which may include a label, instruction, or other data that the auction item 134 is intended for use by a male or a female. This data may be accessible to a participant 160 even though the identity of the auction item 134 is concealed. In another embodiment, the information 132 includes a value amount of the auction item 134, which may be suggested by the donor 170 or established by a coordinator of the auction system 100. This value amount from the information 132 may be set as the minimum or maximum amount for the corresponding auction item 134, or may be merely a suggested retail value of the item, and may be helpful in assisting participants 160 decide how much to bid for the auction item 134, particularly in embodiments in which the identity of the auction item 134 is concealed during the auction event 130. It should be noted, however, that even if concealed during the auction event 130, the identity of the auction item 134 is revealed to the winning participant 160. In one embodiment, the identity of the item 134 is revealed to the winning participant upon the close of the auction event 130. In another embodiment, the identity of the auction item 134 is revealed upon shipment and receipt of the physical item 134 to the winning participant 160. In still another embodiment, the identity of the auction item 134 is made available or revealed a predetermined amount of time in advance of the auction event, such as a few days or hours in advance of beginning the auction, although is not available prior to that time.

As can be appreciated from the preceding discussion, the auction management assembly 110 is further structured to be accessible to at least one participant 160 through the network 120. The participant 160 may view and access the auction management assembly 110 through the network 120 via use of a personal computer, laptop, mobile device, smart phone, personal digital assistant, or other device capable of accessing the network 120. Accordingly, such devices are configured to access the network 120 through the Internet, Wi-Fi® or Bluetooth® connection, or other appropriate connection.

Figure 3:
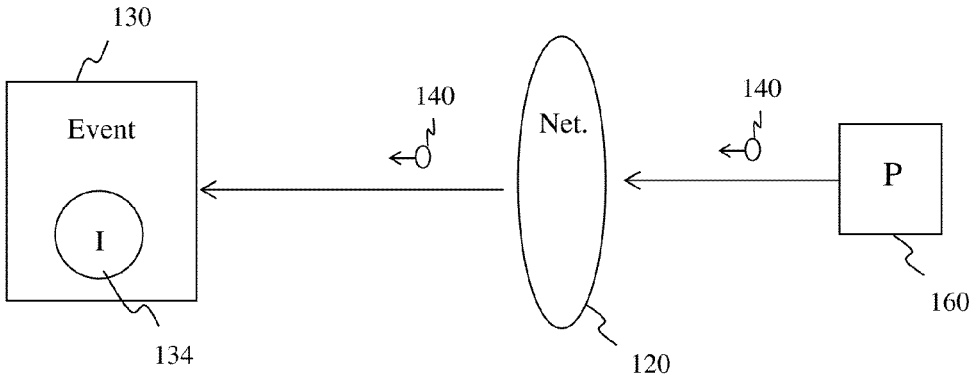
FIG. 3 is a schematic representation of one embodiment of the access fee of the present system.
Figure 4:
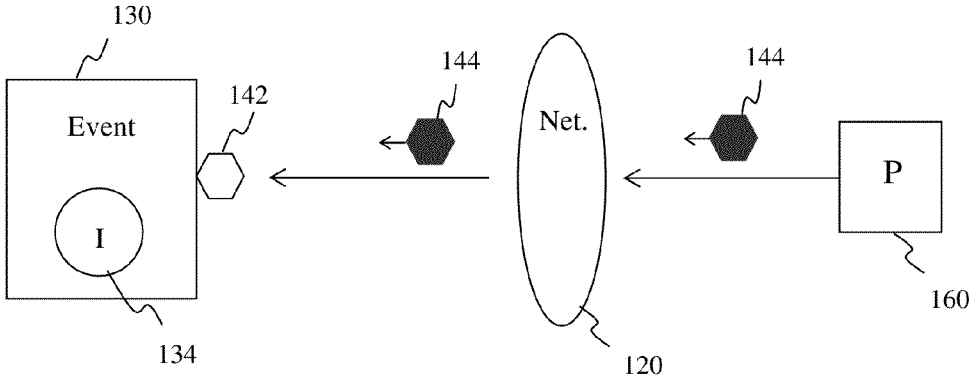
FIG. 4 is a schematic representation of one embodiment of an entry requirement and entry fee in accordance with the present invention.

As previously indicated, and as depicted in FIGS. 1, 3 and 4, the auction system 100 of the present invention also comprises at least one auction event 130 which is structured to present information 132 pertaining to an auction item 134. In the embodiment of FIG. 1, the auction system 100 comprises a plurality of auction events 130, wherein each auction event 130 is structured and configured to present information 132 pertaining to a different one of the auction items 134 to be sold. Accordingly, each auction event 130 corresponds to one auction item 134, and includes the structure necessary to present information 132 on that auction item 134, such as interface capabilities.

The auction system 100 further comprises an access fee 140 defining entry of at least one participant 160 to an auction event 130. In embodiments having more than one auction event 130, each auction event 130 corresponds to a particular access fee 140. In other words, an access fee 140 is required to join an auction event 130 and bid on an item 134, and each auction event 130 has its own access fee 140, which may be the same value or different value than the access fee 140 for other auction events 130. As shown in FIGS. 1 and 3, the access fee 140 is supplied by a participant 160 in order to enter, join, access, or otherwise participate in an auction event 130. It should be noted, however, that the access fee 140 is not required to simply view an auction event 130, such as to watch the progress of a particular auction. The access fee 140 is needed to participate in the auction event 130, such as to bid for an item 134.

Moreover, the access fee 140 comprises a predetermined value, such as a fixed value amount. In some embodiments, the value amount is a particular amount of money or currency. In other embodiments, the value amount is a predetermined number of "points" or "credits". In these embodiments, a participant 160 purchases or earns "points" or credits" having value in the auction system 100, which can be connected to and/or associated with an account dedicated for that participant 160. The participant 160 can then apply any number of the "points" or "credits" as an access fee 140 to access a particular auction event 130. It should therefore be appreciated that the value amount of the access fee 140 need not be defined monetarily, but can be defined by any form of value recognized by the auction system 100.

Further, the timing of action on the access fee 140 may vary. For instance, in the embodiment of FIG. 3, the access fee 140 comprises a fixed value amount that is satisfied prior to submitting a first bid on an auction item 134. In another embodiment, the access fee 140 comprises a fixed value amount satisfied simultaneously with submittal of a first bid.

In at least one embodiment, the auction system 100 comprises an entry requirement 142 and corresponding entry fee 144. As schematically represented in FIG. 4, the entry requirement 142 defines a threshold participation value and is structured to restrict access to a corresponding auction event 130. The defined threshold participation value may be a monetary value amount, such as a currency level, "point" or "credit" amount, or other value amount recognized by the system 100. Moreover, this entry requirement 142 is a threshold, or minimum amount, required to access, join, or participate in the auction event 130. The threshold participation value may be set automatically by the auction management assembly 110, or by a coordinator of the auction system 100. Until the entry requirement 142 is satisfied, access to participate or place a bid in the auction event 130 is restricted, denied, or not permitted.

As depicted in FIG. 4, the entry fee 144 comprises a value amount equivalent to the threshold participation value of the entry requirement 142. For instance, if the threshold participation value is a currency amount, the entry fee 144 is correspondingly the same currency amount. For example, if the entry requirement 142 is five dollars, then the entry fee 144 is five dollars. If the threshold participation value is a required number of "points," the entry fee 144 is the same number of "points." Moreover, the entry fee 144 is supplied by a participant 160 in order to gain access to an auction event 130.

Figure 4A:
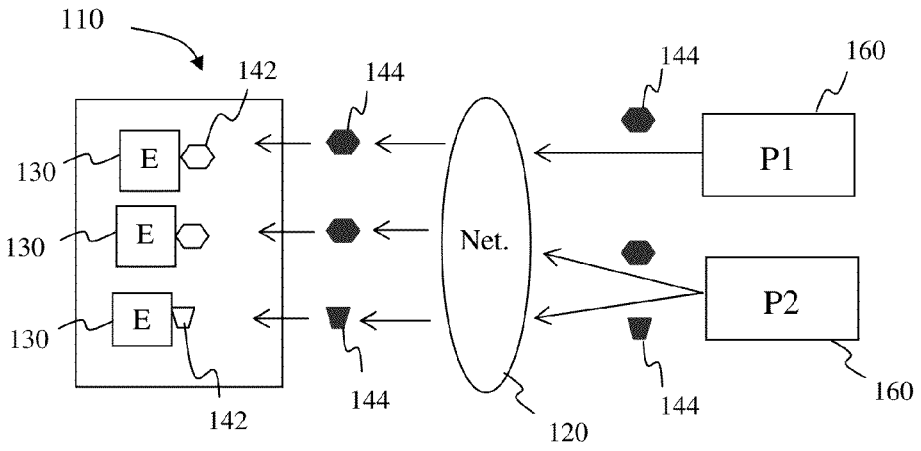
FIG. 4A is a schematic representation of another embodiment of the present system including a plurality of auction events, a plurality of entry requirements, and a plurality of entry fees.

In the embodiment of FIG. 4A, the auction system 100 comprises a plurality of auction events 130. Accordingly, the system 100 further comprises a plurality of entry requirements 142, each corresponding to a different one of the plurality of auction events 130. The entry requirements 142 may have the same value amount or different value amounts, such that each auction event 130 may cost the same to enter, or different auction events 130 may cost different amounts to enter. Indeed, each entry requirement 142 may be a unique value amount different from every other entry requirement 142. Further, and continuing with FIG. 4A, the system 100 also comprises a plurality of entry fees 144, each having a value amount equal to a different one of the entry requirements 142. Accordingly, if the entry requirements 142 have different amounts, the entry fees 144 will be of different amounts, and will correspond to appropriate ones of the entry requirements 142. Further, the entry fees 144 may be provided by the same participant 160 or different participants 160, and each participant 160 may submit multiple entry fees 144 to access multiple auction events 130.

Figure 4B:
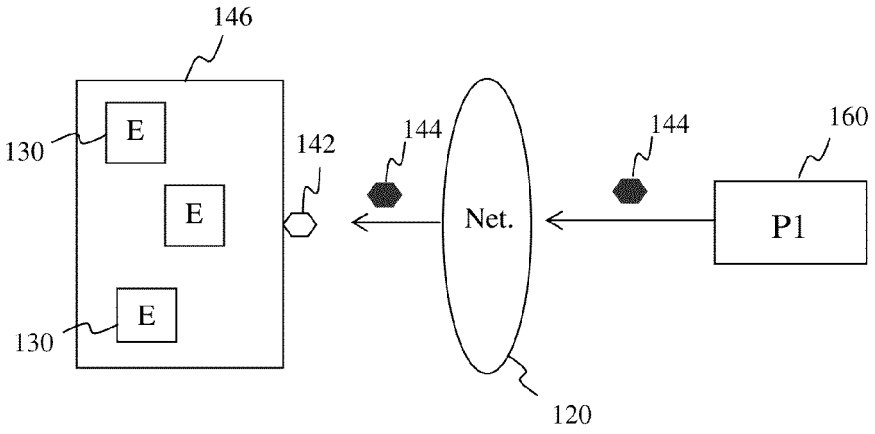
FIG. 4B is a schematic representation of another embodiment of the present system including an auction room comprising a plurality of auction events.

In the embodiment shown in FIG. 4B, the auction system 100 comprises an auction "room" 146 comprising a plurality of auction events 130. The auction room 146 is a virtual room or location in which a participant 160 can access multiple auction events 130. Each auction event 130 involves a different auction item 134. These auction events 130 may be ongoing simultaneously, although there is no requirement that they all start and/or end at the same time. Indeed, each auction event 130 may have its own beginning and ending time, and are conducted independently of the other auction events 130 located within a common auction room 146. In some embodiments, the auction room 146 has a theme wherein all of the auction events 130 contained or located therein are directed towards items 134 falling within a particular theme, such as children's toys, items from a particular donor, etc.

Importantly, the auction room 146 comprises an access fee, defined in FIG. 4B as an entry requirement as indicated at 142, having a predetermined value and defining entry of a participant 160 into the auction room 146. Each auction event 130 located therein, however, does not have an access fee. Accordingly, once a participant 160 pays the entry fee 144 to enter the auction room 146, he or she can view, participate in, and place a plurality of bids free of additional charges in any and all of the auction events 130 contained within the auction room 146. Moreover, the auction room 146 may be open for anyone to join, in that any participant 160 who wishes may pay the entry fee 144 and gain entry to the auction room 146. However, some auction rooms 146 may be designated "by invitation only" such that a participant 160 cannot gain entry unless first invited, such as by the auction coordinator, and then pay the entry fee 144. In additional embodiments, the system 100 comprises a plurality of auction rooms 146, each having a plurality of auction events 130.

Figure 5A:
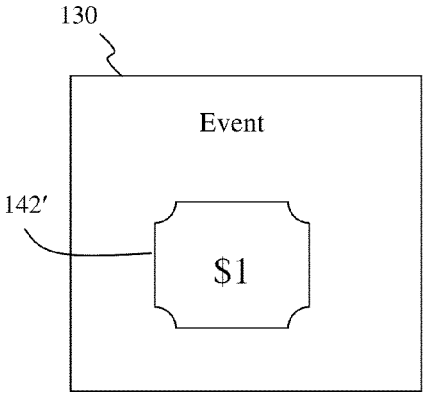
FIG. 5A is a schematic representation of one embodiment of an auction event of the present system and an entry requirement comprising a particular value amount.

Turning now to FIGS. 5A-5D, the entry requirement 142 and the entry fee 144 each comprise a different icon format 142', 144' respectively when presented on an interface, such as a user interface, and includes a plurality of icons. Specifically, the entry requirement(s) 142 comprises an icon format 142' that is structured to symbolically represent the entry requirement 142 to a user, such as a participant 160, over the network 120. For instance, the icon format 142' may be presented through a user interface or other structure to permit transmittal of symbolic information. In some embodiments, such as shown in FIG. 5A, the icon format 142' comprises an icon indicating the threshold participation value defined by the corresponding entry requirement 142, such as one dollar. In other embodiments, the icon format 142' comprises a graphical icon, such as a lock, safe, or other image.

Figure 5B:
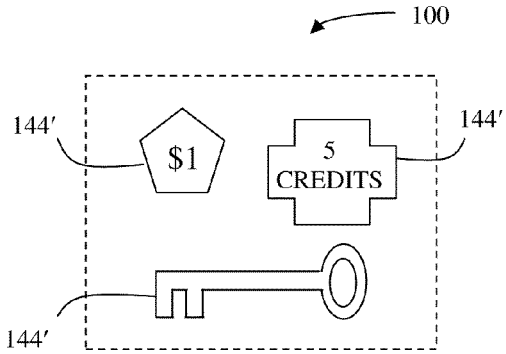
FIG. 5B is a schematic representation of one embodiment of the auction management assembly including a plurality of entry fees, each entry fee comprising a different value amount and/or icon format.

As shown in FIG. 5B, the entry fee(s) 144 also comprise an icon format 144' structured to symbolically represent an entry fee 144 to a user over the network 120. In some embodiments, the icon format 144' of the entry fee 144 is substantially the same or similar to the icon format 142' of the corresponding entry requirement 142. In other embodiments, the icon format 144' of the entry fee 144 is different and distinct from the icon format 142' of the entry requirement 142, and so is distinguishable therefrom. In some embodiments, the icon format 144' comprises a graphical representation or indication of a value amount corresponding to the particular entry fee 144, such as one dollar or five "credits". In another example, the icon format 144' for the entry fee 144 comprises a graphical icon, such as a key or other image, word, phrase, etc. As depicted in FIG. 5B, the system 100 comprises a plurality of icon formats 144' each corresponding to a different entry fee 144. These entry fees 144 may comprise different value amounts, reflected by the image of the icon format 144'.

Moreover, each icon format 144' and its associated entry fee 144 has a corresponding icon format 142' and entry requirement 142 having the same value amount. In other words, the corresponding icon format 142' of the entry requirement 142 and icon format 144' of the entry fee 144 match each other. Accordingly, a participant 160 may choose a particular icon format 144' corresponding to the entry fee 144 having the same value as the entry requirement 142 of the auction event 130 they wish to join or gain access.

Figure 5C:
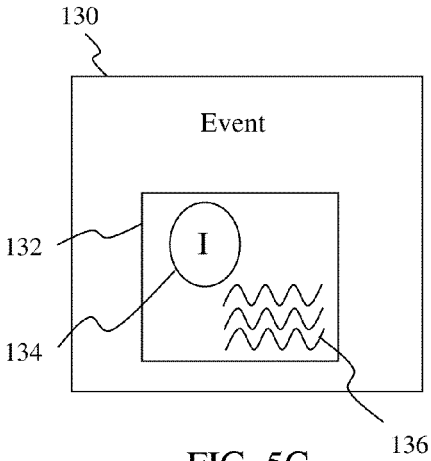
FIG. 5C is a schematic representation of the auction event of FIG. 5A in which a corresponding entry fee has been applied to the entry requirement, and the auction item information is accessible to the participant.
Figure 5D:
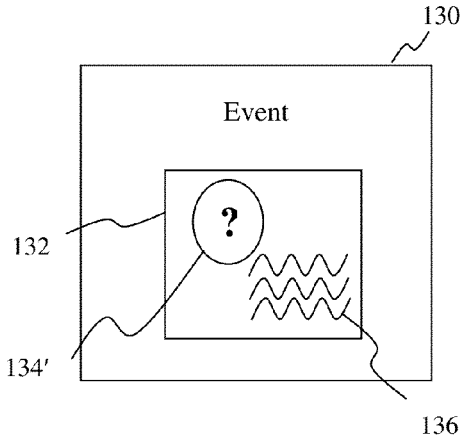
FIG. 5D is a schematic representation of another embodiment of the auction event of FIG. 5C in which the identity of the auction item is concealed.

As described above, the auction event 130 is structured to present the information 132 pertaining to the auction item 134 being sold in that auction event 130 to the network 120, as depicted in FIGS. 5C and 5D. Accordingly, the information 132 is accessible to a participant 160 once access is granted, as described above with reference to the entry requirement 142 and entry fee 144, or by satisfaction of the access fee 140. In at least one embodiment, as in FIG. 5C, the information 132 includes the identity of the auction item 134, which is presented and/or accessible during the auctioning of the item 134. The information 132 may further include additional descriptors 136 that describe the auction item 134, such as a suggested value, measurements, dimensions or other size indicators, materials, condition status, etc, as described previously. In at least one other embodiment, as shown in FIG. 5D, the identity of the auction item 134' is concealed during the course of the auction event 130. However, other descriptors 136 may be presented. In still other embodiments, the identity of the auction item 134' is initially concealed, but then is revealed a predetermined amount of time in advance of the auction, such as a few hours or days.

Returning to FIG. 1, the present auction system 100 further comprises at least one bid 150 which is indicative of an attempt to obtain or purchase a particular auction item 134 by a participant 160. For instance, in at least one embodiment, the bid 150 comprises a suggested purchase amount or value for the auction item 134 to which the bid 150 is applied. The value may be monetary or other forms of value recognized by the auction system 100, such as "points" or "credits". Accordingly, the bid 150 is supplied by a participant 160, as depicted in FIG. 1. However, the bid 150 may only be supplied or provided once access to the auction event 130 is permitted, such as described previously.

Moreover, the at least one bid 150 is independent or free of an associated cost to place the bid 150. Once access to the auction event 130 is permitted, each bid 150 may be supplied free of charge.

Figure 6:
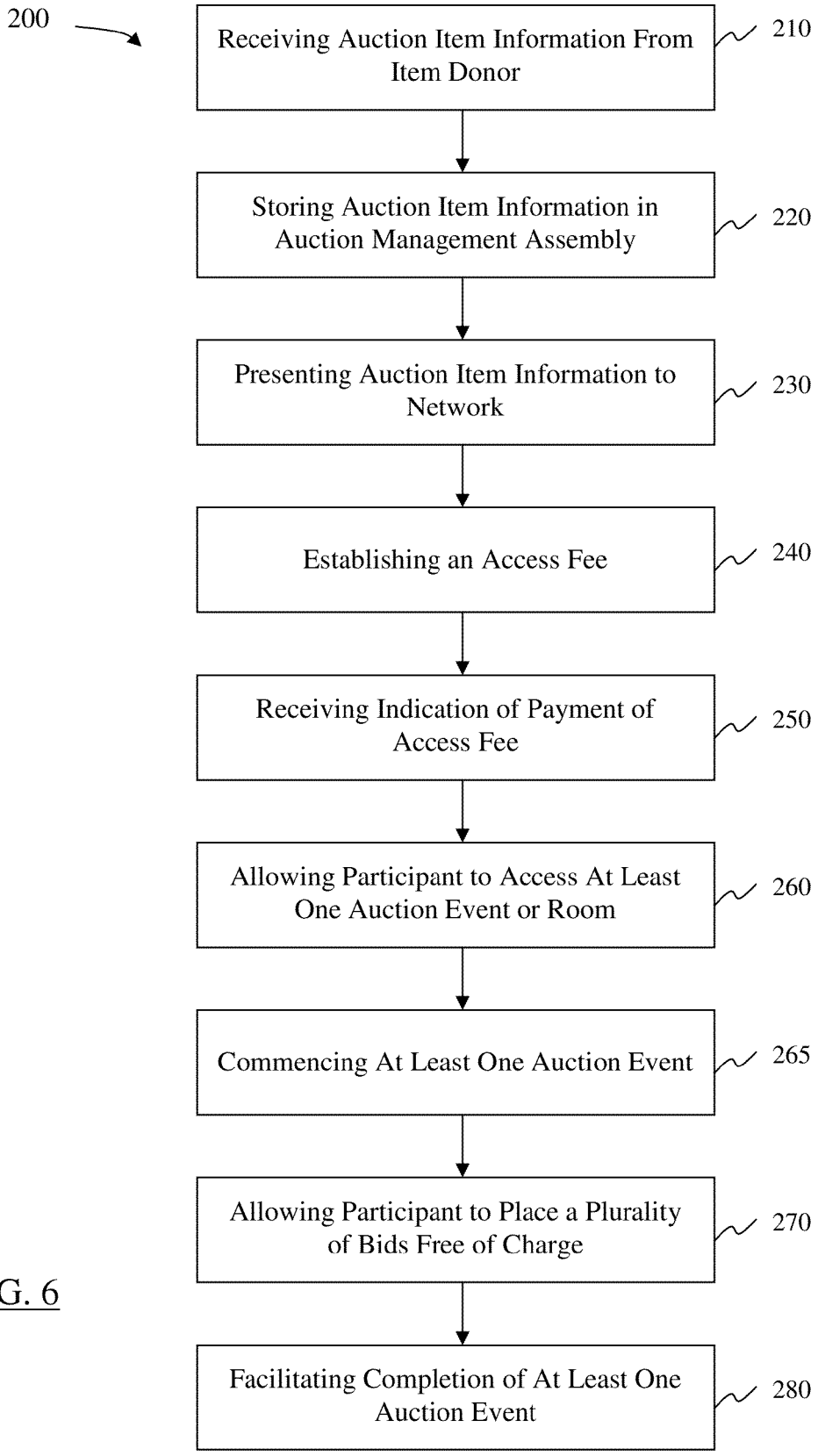
FIG. 6 is a diagram of the method of the present invention.

The present invention is also directed to a method of providing a single fee online auction, generally represented as 200 and diagrammed in FIGS. 6-9. With particular reference to FIG. 6, the present method 200 comprises receiving auction item information for an auction item from an item donor, as at 210. The item information 132 is received, as at 210, through a network 120.

As mentioned previously, the physical item is not provided, but rather information 132 relating to the item 134 is provided by the item donor 170. Accordingly, the item donor 170 can retain possession of the item 134 until such time as the auction is complete, at which point the item donor 170 may arrange for delivery of the physical item to the winning participant 160. Also as mentioned previously, the donor 170 need not be a third party, and may be the coordinator of the auction event 130 and provide their own items for auction.

The present method 200 also comprises storing the auction item information in an auction management assembly comprising a computing device, as at 220. For example, the auction item information 132 may be stored on memory 116 of the computing device 114, as described previously. Storage of the auction item information, as at 220, permits the auction system 100 to host the auction event 130 for the item 134 without further input from the item donor 170. In at least one embodiment, storing the item information, as at 220, occurs soon after receiving the information. In at least one other embodiment, storing the item information, as at 220, occurs simultaneously with receiving the information. For example, the information may be uploaded from the donor 170 to a server or other computing device 114 of the auction system 100. Further, storing the item information, as at 220, can comprise storing the item information in temporary short-term storage structure, or in long-term storage structure, as described in greater detail above.

The method 200 further includes presenting the auction item information from the auction management assembly to a network viewable to at least one user, as at 230. This step is accomplished by accessing the stored information 132 from the auction management assembly 110 and transmitting the information 132 to the network 120 for presentation.

Figure 7:
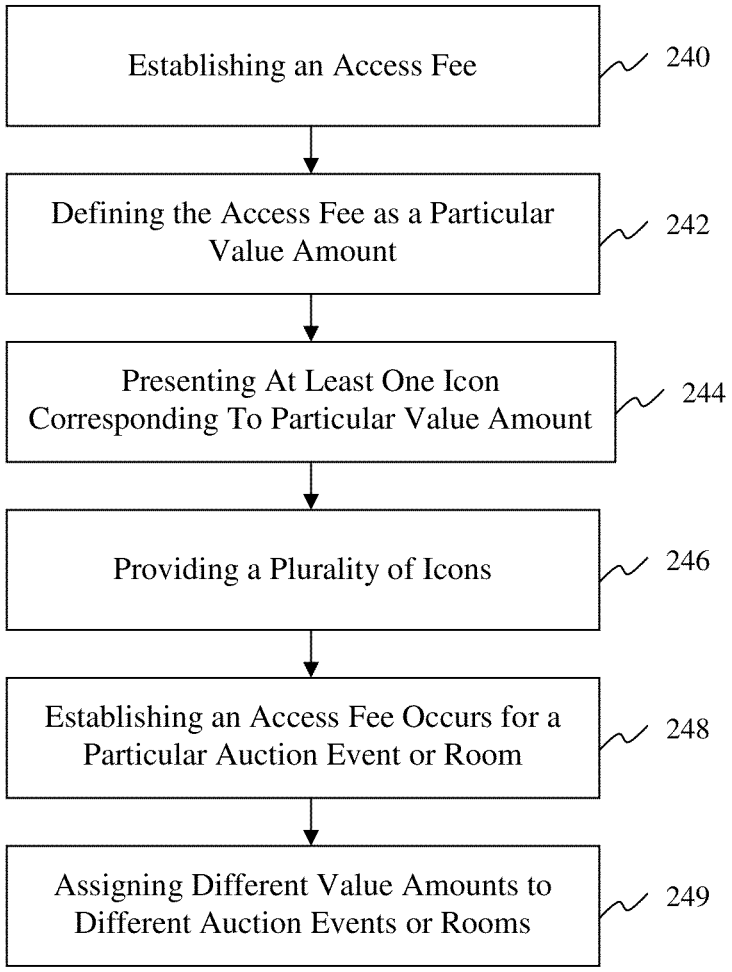
FIG. 7 is a diagram of establishing an access fee of the method of FIG. 6.

The method 200 also comprises establishing an access fee 140 associated with the auctioning of the auction item, as at 240. In at least one embodiment, as shown in FIG. 7, the step of establishing the access fee, as at 240, comprises defining the access fee 140 as a particular value amount, as at 242. Defining the access fee, as at 242, may be accomplished automatically by a component of the auction system 100, such as the auction management assembly 110, or it may be set by a coordinator acting on the auction management assembly 110 in order to establish or set up an auction event 130.

With further reference to FIG. 7, in at least one embodiment of the present method, establishing an access fee, as at 240, also comprises presenting at least one icon corresponding to a particular value amount, as at 244. This icon represents the value amount associated with the particular access fee of the corresponding auction event 130.

In at least one embodiment, as shown in FIG. 7, establishing the access fee, as at 240, further comprises providing a plurality of icons, each corresponding to a different value amount, as at 246. Accordingly, a participant 160 can choose the icon corresponding to the access fee 140 required to join a particular auction event 130. Presenting the plurality of icons, as at 246, provides the participant 160 with a variety of options of access fees 140 to choose from.

Also as depicted in FIG. 7, establishing the access fee occurs for a particular auction event or room, as at 248. Where there is a plurality of auction events 130 or auction rooms 146, establishing the access fee occurs for each auction event 130 or auction room 146, so that each auction event 130 or room 146 has a particular access fee 140 assigned or designated to gain entry.

Moreover, as also seen in FIG. 7, establishing the access fee, as at 240, also comprises assigning different value amounts to different auction events or rooms, as at 249. Assigning different value amounts, as at 249, may occur simultaneously or sequentially, depending on the particular structure involved to perform the method 200.

Returning to FIG. 6, the method 200 of the present invention further comprises receiving indication of payment of said access fee by at least one participant, as at 250. The indication of payment can come from any number of sources, including from the at least one participant 160, or from a bank, credit union, or other money management source or authority, or can be a relayed signal from any of these initial sources. Accordingly, in at least one embodiment, payment of the access fee 140 is sent from the participant 160 to the money management source, which then in turn sends an indication to the auction system 100 that payment has been made. Such payment corresponds to the access fee 140 required for the participant 160 to join a particular auction event 130 or auction room 146. Further, receiving the indication of payment, as at 250, may occur via the network 120.

Upon receiving indication that the access fee 140 has been paid, as at 250, the method 200 further comprises allowing the participant to access at least one auction event or auction room, as at 260. The auction event 130 is now open to the participant 160, who may view information 132 contained therein and act in the auction event 130.

Figure 8:
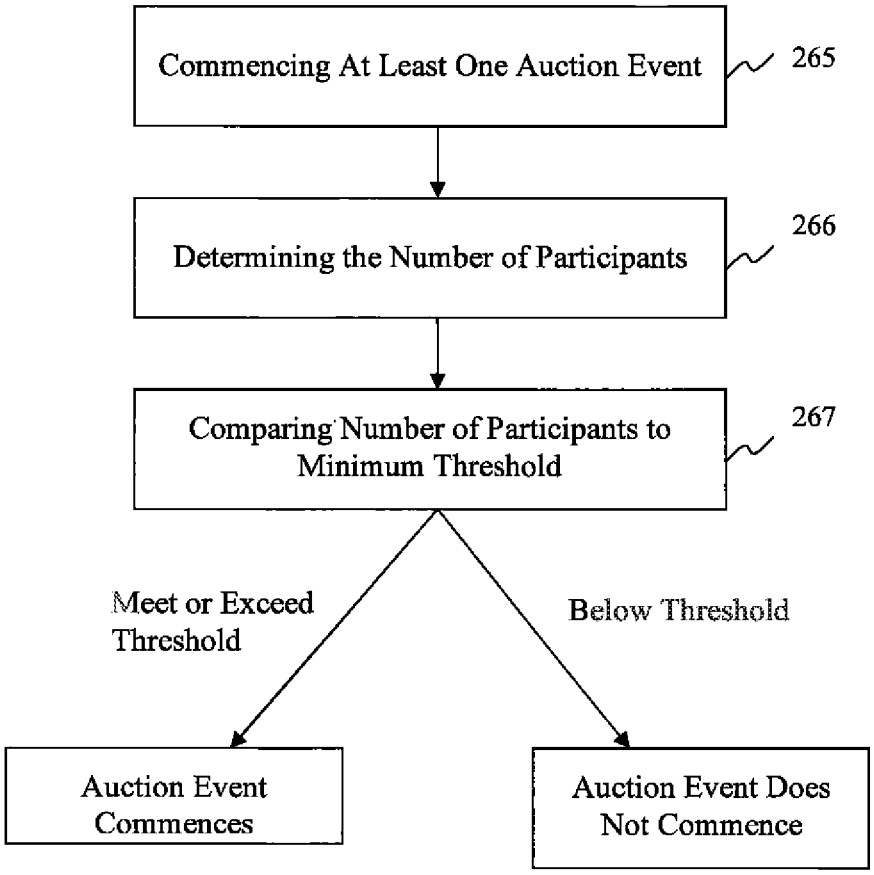
FIG. 8 is a diagram of one embodiment of commencing an auction event of the method of FIG. 6.

The method 200 further comprises commencing the at least one auction event, as at 265. In some embodiments, commencing an auction event occurs at a predetermined time, such as may be set by the auction coordinator. In other embodiments, as shown in FIG. 8, commencing an auction event comprises determining the number of participants that have gained access to the auction event, as at 266, and comparing the number of participants present to a predetermined minimum threshold such as may be set by the auction coordinator, as at 267. If the number of participants present meets or exceeds the minimum threshold, then the auction event 130 commences. If the number of participants present is below the threshold, then the auction event does not commence. Accordingly, an auction event 130 may require a predetermined minimum number of participants to begin, and commencement of the auction event 130 occurs only once this threshold is met. In some embodiments, if the threshold number of participants is not met within a predetermined amount of time, such as a certain number of minutes or hours from the entry of the first participant into the auction event 130, then the auction event 130 may be cancelled, such as by the auction coordinator, program monitoring, hosting, and/or managing the auction event 130, etc.

It should be appreciated that the above-described determination of the number of participants and minimum threshold requirements to commence an auction can apply to individual auction events 130 as well as to virtual auction rooms 146. That is to say, in some embodiments, activity within a virtual auction room 146, such as auction events 130 located therein, may commence only once a certain predetermined number of participants have entered the room 146.

The method 200 further comprises allowing the participant to place a plurality of bids free of charge, as at 270 and referenced in FIG. 6. The participant 160 may choose to enter a single bid 150, multiple bids 150, or no bids in an auction event 130. Regardless of the number of bids 150 placed, the method 200 of the present invention allows for the placement of a plurality of bids 150, and does not charge for any of bids 150 actually placed. Moreover, in embodiments comprising an auction room 146 having a plurality of auction events 130, once the participant 160 has gained entry to the auction room 146, he or she is allowed to participate in any of the auction events 130 found therein, and to place a plurality of bids 150 in multiple auction events 130. Each bid 150, even if placed in different auction events 130, is free of charge, so long as they are placed in auction events 130 located in a common auction room 146.

Figure 9:
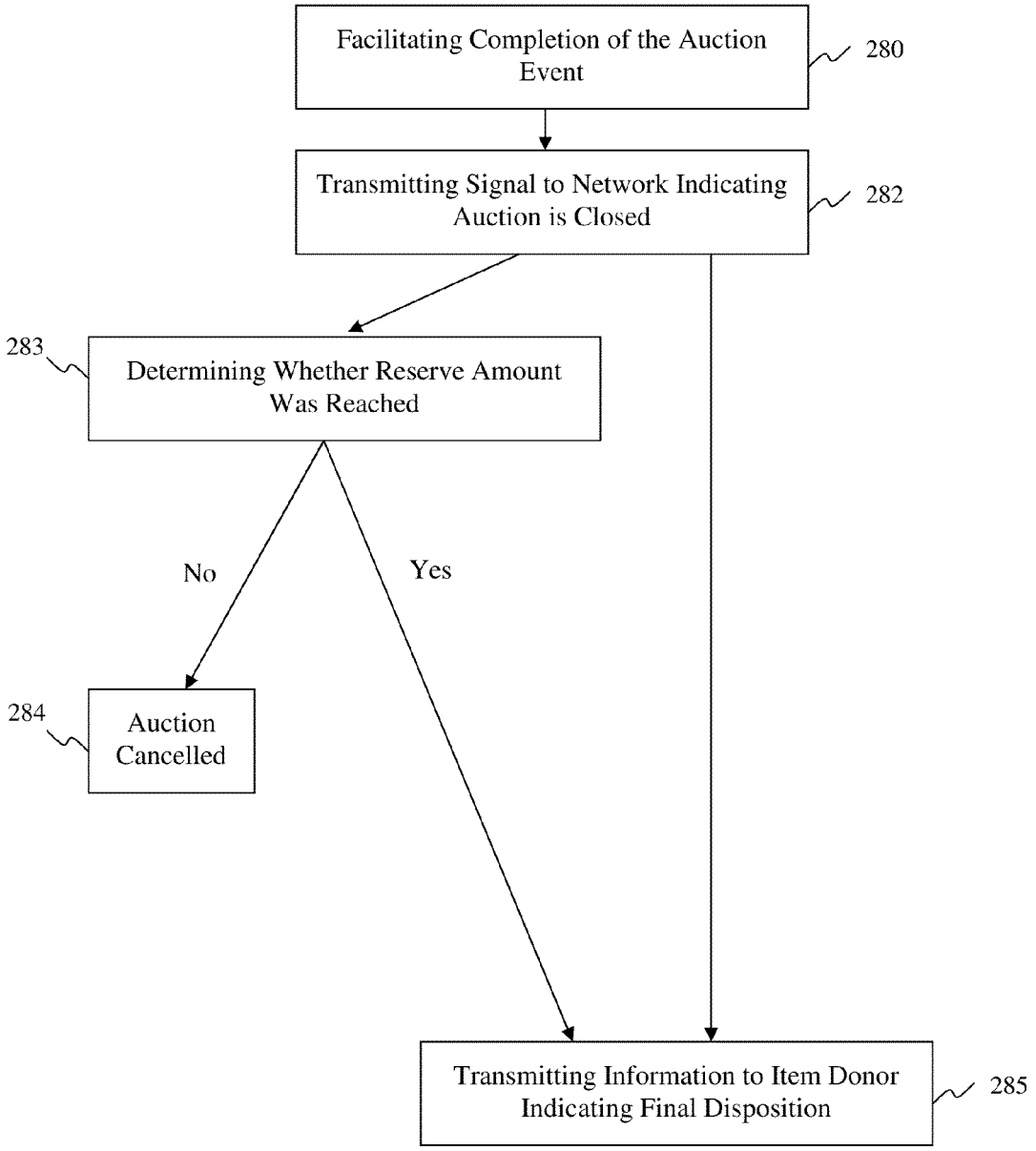
FIG. 9 is a diagram of facilitating completion of an auction event of the method of FIG. 6.

Finally, the method 200 comprises facilitating the completion of the at least one auction event, as at 280, seen in FIGS. 6 and 9. With particular reference to FIG. 9, facilitating the completion of the auction event, as at 280, comprises transmitting a signal to the network 120 indicating the auction event 130 is closed, as at 282. This signal is transmitted over the network 120, and may be a packet of information sufficient to convey the close or end of the auction event 130, such as a message presented on an interface to the network 120 and accessible by the participants 160. By way of example only, the auction event 130 may be closed when the time allotted for the auction event 130 expires or when the winning bid 150 is placed. The auction event 130 may also be closed upon receiving a bid 150 for a value amount equivalent to the maximum amount or predetermined "buy it now" price set for that particular auction item 134. The auction event 130 may also be closed upon action by a component of the system 100, such as the auction management assembly 110 or by a user, such as the coordinator, who may manually override and terminate the auction event 130.

In some embodiments, such as a reserve auction, facilitating completion of the auction event comprises determining whether a reserve amount was reached in the auction event, as at 283. This comprises multiplying the total number of participants in an auction event by the value of the access fee, and adding the amount of the final or highest bid. This resulting number is compared to the reserve amount that has been previously established, such as by the auction coordinator. If the resulting number meets or exceeds the reserve amount, then the auction event is finalized, as described below. If the resulting number is less than the reserve amount, then the auction event 130 is deemed a cancelled auction, and the value for the access fees are returned to each participant 160, as at 284.

Facilitating completion of the auction, as at 280, further comprises transmitting information to the item donor indicating the final disposition of the auction event, as at 285, in FIG. 9. This information, represented schematically as 138 in FIG. 1, may include identification of the winning participant 160, the amount of the winning bid 150, the number of bids 150 placed, the total number of participants 160, or that the auction item 134 was not successfully sold. The item donor 170 may then use this information 138 to determine whom to deliver the auction item 134 to, and from whom to collect payment.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of providing a single fee online auction comprising:

accessing an auction management assembly, defining the auction management assembly to comprise: a central processing unit, communication capabilities, and a central processing unit, operating the auction management assembly over a network through use of the communication capabilities, receiving auction item information by the auction management assembly from an item donor through the network, storing the auction item information in the memory of the auction management assembly, presenting the auction item information from the auction management assembly to the network viewable to at least one user, establishing an access fee associated with auctioning of the auction item, receiving of the auction management assembly indication of payment of the access fee by at least one participant, allowing the at least one participant to access at least one auction event through the network, commencing the at least one auction event, allowing the at least one participant to place a plurality of bids free of charge, and facilitating the completion of the at least one auction event.

2. The method of claim 1 wherein said establishing an access fee comprises defining the access fee as a particular value amount.

3. The method of claim 2 wherein said establishing an access fee comprises presenting at least one icon corresponding to the particular value amount.

4. The method of claim 3 wherein said establishing an access fee comprises providing a plurality of icons wherein each of said icons correspond to a different value amount.

5. The method of claim 1 wherein said establishing an access fee occurs for at least one particular auction event.

6. The method of claim 5 wherein said establishing an access fee comprises assigning different value amounts to different auction events.

7. The method of claim 1 wherein said commencing at least one auction event comprises determining the number of participants that have gained access to the at least one auction event, comparing the number of participants present in the at least one auction event to a predetermined minimum threshold, and commencing the at least one auction event if the number of participants present meets or exceeds the minimum threshold.

8. The method of claim 1 wherein said allowing the at least one participant to place a plurality of bids free of charge applies to a single auction event.

9. The method of claim 1 wherein said facilitating completion of the at least one auction event comprises transmitting a signal to the network indicating the at least one auction event is closed.

10. The method of claim 1 wherein said facilitating completion of the at least one auction event comprises determining whether a reserve amount was reached in the at least one auction event.

11. The method of claim 10 wherein determining whether a reserve amount was reached comprises multiplying a total number of participants in the at least one auction event by the value of the access fee for the at least one auction event and adding the amount of the final bid placed in the at least one auction event, and comparing the resulting number to a predetermined reserve amount.

12. The method of claim 11 wherein facilitating the completion of the at least one auction event comprises canceling the at least one auction event if the resulting number is less than the predetermined reserve amount.

13. The method of claim 1 wherein said facilitating completion of the at least one auction event comprises transmitting information to the item donor indicating the final disposition of the at least one auction event.

14. The method of claim 1 wherein said allowing the at least one participant to access at least one auction event comprises disposing the at least one auction event in an auction room.

15. The method of claim 14 wherein said allowing the at least one participant to place a plurality of bids free of charge applies to a plurality of auction events located within the same auction room.

* * * * *